US006367975B1

(12) United States Patent
Cronauer et al.

(10) Patent No.: US 6,367,975 B1
(45) Date of Patent: Apr. 9, 2002

(54) PACKAGING WEB AND PROCESS

(75) Inventors: William M. Cronauer, Tallmadge; Bernard Lerner, Aurora, both of OH (US)

(73) Assignee: Automated Packaging Systems, Inc., Streetsboro, OH (US)

( * ) Notice: Subject to any disclaimer, the term of this patent is extended or adjusted under 35 U.S.C. 154(b) by 0 days.

(21) Appl. No.: 09/864,733

(22) Filed: May 24, 2001

(51) Int. Cl.[7] ..... B65D 30/10
(52) U.S. Cl. ..... 383/37
(58) Field of Search ..... 383/37

(56) References Cited

U.S. PATENT DOCUMENTS

| | | | | |
|---|---|---|---|---|
| 3,283,673 A | | 11/1966 | Mueller | |
| 3,751,875 A | * | 8/1973 | Membrino | 383/37 X |
| 3,791,573 A | | 2/1974 | Titchenal et al. | |
| 4,558,556 A | * | 12/1985 | Jostler | 383/37 X |
| 4,598,421 A | * | 7/1986 | Jostler | 383/37 |
| 4,655,737 A | | 4/1987 | Benoit | |
| 4,665,552 A | | 5/1987 | Lems et al. | |
| 4,680,205 A | | 7/1987 | Lerner et al. | |
| 4,887,913 A | * | 12/1989 | Sengewald | 383/37 X |
| 4,945,714 A | | 8/1990 | Bodolay et al. | |
| 5,045,040 A | | 9/1991 | Vetter | |
| 5,226,858 A | | 7/1993 | Snowdon | |
| 5,470,419 A | | 11/1995 | Sasaki et al. | |
| 5,514,067 A | | 5/1996 | Schmidt et al. | |
| 5,519,982 A | | 5/1996 | Herber et al. | |
| 5,711,751 A | | 1/1998 | Harmanoglu | |
| 5,722,218 A | | 3/1998 | Lerner | |
| 5,733,045 A | * | 3/1998 | Jostler et al. | 383/37 |
| 5,743,070 A | | 4/1998 | Lerner et al. | |
| 5,944,424 A | | 8/1999 | Lerner et al. | |
| 6,035,611 A | | 3/2000 | Lerner | |

* cited by examiner

*Primary Examiner*—Jes F. Pascua
(74) *Attorney, Agent, or Firm*—Watts, Hoffman, Fisher & Heinke Co., LPA

(57) ABSTRACT

A packaging web is disclosed. The web is an elongate, flattened plastic tube having face and back sides delineating the faces and backs of a set of side by side bags. The tube includes an elongated top section and spaced sets of side seals each extending transversely from the bottom to a location near the top section. The side seals of each set delineate sides of adjacent bags such that the sides and bottoms delineate the perimeters of a set of open top bags. The top section is essentially a bottom open tube for providing bag support when the web is fed into a bag loading machine. The web includes superposed, spaced lines of weakness in each of the face and back sides delineating tops of the bags. Each such spaced line of weakness extends substantially across an associated bag top and terminates in spaced relationship with an associate one of the spaced lines of weakness to leave solid sections in the face and back sides.

4 Claims, 2 Drawing Sheets

PACKAGING WEB AND PROCESS

This invention relates to packaging and more particularly to a novel and improved web of side connected open bags and a process of packaging with such a web.

BACKGROUND OF THE INVENTION

U.S. Pat. No. 5,743,070, issued Apr. 28, 1995 to Hershey Lerner and Dana J. Liebhart under the title of PACKAGING MACHINE, MATERIAL AND METHOD, discloses a machine and process of packaging with side connected bags. U.S. Pat. No. 5,944,424 of Aug. 31, 1999 is a patent issuing from a divisional application which claims the packaging web as disclosed in both patents (the SP Patents).

With the machine of the SP Patents, webs of side connected bags are used. Each web is an elongated, flattened, plastic tube which includes a top section which itself is essentially a tube. In use the top section is fed over a mandrel and past a slitter which separates the top section into two upstanding lips. The lips are grasped by unique belts that are fed along divergent paths of travel into parallel paths through a load station. The unique belts are described more fully in U.S. Pat. No. 5,722,218 issued Mar. 3, 1998 to Hershey Lerner under the title PLASTIC TRANSPORT SYSTEM (herein "the Belt Patent"). The disclosures of the SP Patents and the Belt Patent are incorporated by reference.

Each web includes side connected bags which depend from the lips. As a web is fed along its path of travel through a machine of the SP Patent (the SP Machine), lines of weakness interconnecting sides of adjacent bags are ruptured to leave individual bags depending from the lips.

As the belts diverge, the gripped lips are separated from the depending bags along lines of weakness to the extent necessary to cause the bags to span the space between the parallel paths in a generally rectangular opening.

As indicated in U.S. Pat. No. 6,035,611 issued Mar. 14, 2000 and disclosing an improved process of making such a web, (the Process Patent) the system disclosed in the SP patents has, on occasion, experienced difficulty. More specifically, there is a tendency for bags to fail to open in the intended rectangular shape because the separation of supporting lips from the front and back faces of the bags is not equal. This appears to be due, at least in part, to the manner in which a pair of lines of continuous perforations are formed along the web. Too often the webs are not perforated evenly in both the front and back webs. This occurs because, toothed rotary knives used to form the continuous perforations, have pointed teeth. The teeth penetrate through one web into the other in forming the perforations. Since the teeth are pointed, the length of each perforation in the first penetrated web is greater than in the other.

While the process disclosed and claimed in the Process Patent has diminished the scope of the problem, there remains a problem in that all too often a lead portion of the bag will open to a greater extent than a trailing portion as the web is fed into and through a load station.

A somewhat similar system utilizes special guide tracks which support a specialized web. In one embodiment, that specialized web has upstanding lips, each of which has a section of an associated, continuous, enlarged top portion. The top portions are supports that are fed into the special guides that are in the form of tubes. The tubes are open at the bottom so that the web hangs from the enlarged portions. The web has a series of side connected bags suspended from the continuous top portions. Lead and trailing sections of each bag are slit an appropriate amount to permit the bag to open a desired amount and hopefully to a rectangular shape. Since neither the specialized guides nor the web can be adjusted, there is a need for precision in the manufacture which, given manufacturing tolerances, is at best difficult to obtain. Moreover, as the bags are fed to a load station, they are only supported in central portions and not throughout their longitudinal lengths. Further, because of the special guide tracks, the cost of making the guide tracks and a packaging web is greater than the cost of making a web for the SP Machine. Moreover in use change over from one packaging run to another is far simpler with the SP machine.

Accordingly, it would be desirable to refine the applicant's system to provide a web in which bags reliably and consistently open to rectangular shapes and in which bags are more positively supported than the prior webs of the somewhat similar system to enable packaging of heavier objects. In addition it would be desirable to maintain the ease and speed of change over available with the web of the SP Patents from one packaging operation to another for a different product.

SUMMARY OF THE INVENTION

The present invention is directed to a web of side connected bags which web is an improvement over the webs disclosed and claimed in the SP and Process Patents. The improved web provides the web feed advantages over other prior art that are provided by the webs of the SP and Process Patents. In addition, the web of the present invention assures rectangular opening of bags as they are transported through a load station and enhanced load support enabling the packaging of heavier items than can be supported by the webs of the SP and Process Patents.

The improved web, like the predecessors, is an elongated flatten tube having face and back sides delineating the faces and backs of a set of side by side bags. The tube includes an elongated top section which is adapted to be slit to provide front and back web supporting lips. Spaced sets of side seals extend transversely upwardly from the bottom of the web to delineate sides of adjacent bags.

Unlike the webs of the SP and Process Patents, the tops of the bags each have a spaced pair of, rather than continous, lines of weakness. The spaced pair of each bag extend from further lines of weakness delineating the sides of the bags. The spaced pair of lines of each bag are each of length which is one-half the width of a desired bag opening when a bag is rectangularly configurred as it passes through the load station. The solid web sections between the spaced lines of weakness assure equal opening along the leading and trailing sides of each bag as it passes through the load station. The solid sections also provide enhanced load support for a given material of like chemistry and thickness. Thus heavier products can be packaged and forces resulting from a product being loaded striking a bag are better absorbed.

The improved web of the present invention produces a number of outstanding and indeed unexpected advantages. These advantages occur in both the equipment used to make the web and the equipment used in packaging products. The costs of manufacture and of packaging are both reduced because both the manufacturing and the packaging equipment can be run at higher speeds. Further, the precision required of equipment used to make the bags is reduced, contributing to a reduction in the cost of packaging.

The reduction in the cost of manufacturing and the higher on manufacturing through put achieved occur because the manufacturing tolerances with respect to the side seals and the perforations are far less rigid. The cost of making manufacturing machines is reduced by the elimination of such things as edge guides. The looser tolerances are achieved because there is less loading on the side seals during packaging. Tolerances in the lines of weakness along the tops of the bag are loosened because the packaging process now relies on the solid central sections of the web to control the extent of separation of the top lips from the bags as a web enters the packaging station.

In packaging operations higher through puts are achievable because the webs are better able to withstand forces that are occurring during the packaging operation. In addition for many products where support conveyors have been required in the past, the need for those support conveyors is eliminated.

Accordingly the objects of the invention are to provide a novel and improved packaging web and a method of packaging.

PREFERRED EMBODIMENT OF THE INVENTION

Figure 1:
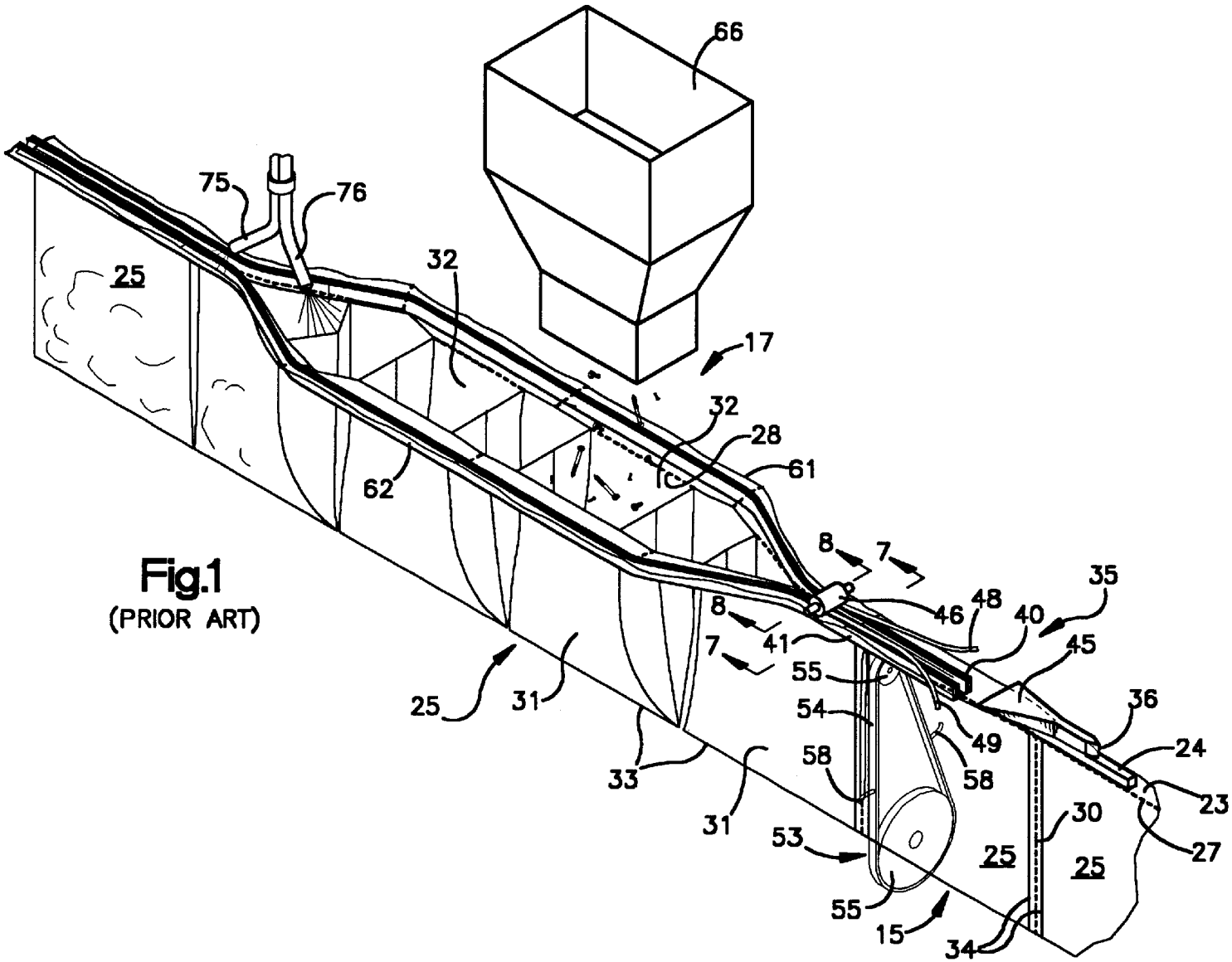
Fig.1 (PRIOR ART)
FIG. 1 is a perspective view showing the web of the SP Patents being fed through a load station of the machine of the SP Patents; and, FIG. 2 is an elevational view of the web of the present invention.

Referring to FIG. 1, a web 15 of side connected bags is provided. The web 15 is fed from a supply (not shown) to a load station 17.

The web 15 is an elongated flattened plastic tube, typically formed of polyethylene. The tube includes a top or lip section 23 for feeding along a mandrel 24. The top section 23 is connected to the tops of a chain of side connected bags 25 by front and back longitudinally extending lines of weakness in the form of perforations 27, 28. Frangible interconnections 30 connect adjacent bag side edges. Each bag 25 includes a face 31 and a back 32 interconnected at a bottom 33 by a selected one of a fold or a seal when the bags are top loaded. When the bags are bottom loaded the bottom of the web will be the top of a package when formed. In that event the web bottom may be a reuseable closure such as those sold under the trademark Ziplock®.

Side seals 34 adjacent the interconnections 30 delineate the sides of the bags 25. The bag faces and backs 31, 32 are respectively connected to the top section 23 by the lines of weakness 27, 28, such that the top section 23 itself is essentially a tube.

The web 15 is fed into a bag feed and preparation station 35. The feed is over the mandrel 24 and past a slitter 36, FIG. 1. The slitter 36 separates the lip section 23 into opposed face and back lips. The feed through the bag feed and preparation portion 35 is caused by a pair of endless, oppositely rotating main transport belts 40, 41 supported by oppositely rotating pulley sets.

A plow 45 is provided and shown in FIG. 1. The plow is positioned a short distance upstream from a roller cam 46. As the lips are drawn along by the main transport belts 41, 42 the lips are respectively folded over the main transport belts under the action of the plow 45.

Once the lips are folded over the tops of the main transport belts 41, 42, the roller cam 46 presses endless lip transport and clamp belts 48, 49 into complemental grooves in the main transport belts 41, 42 respectively. Thus, the grooves function as bag clamping surfaces that are complemental with the clamping belts 48, 49 as is described more fully in the Belt Patent.

A bag side separator mechanism 53 is provided at a bag connection breaking station. The separation mechanism shown is not currently produced for SP Machines. Since it is an operative mechanism and the machine is disclosed for environment and to explain the problem overcome by the present invention, we have not updated that aspect of the present disclosure.

The separator mechanism 53 includes an endless belt 54 which is trained around a pair of spaced pulleys 55 to provide spans which, as shown in FIG. 1, are vertical. The pulleys 55 are driven by a motor, not shown. As the belt is driven breaking pins 58 projecting from the belt 54 pass between adjacent sides of bags to break the frangible interconnections 30. Thus, as the bags depart the bag feed and preparation portion 35, they are separated from one another but remain connected to the lips 38, 39.

The load station 17 includes a pair of parallel belts spreaders 61, 62. The belt spreaders are mirror images of one another. The belt spreaders include spaced channels which respectively guide the main transport belts 40, 41, on either side of the load station 17. When the transport belts 40, 41 are in the channels, as is clearly seen in FIG. 1, the bags 25 are stretched between the belts in a rectangular top opening configuration.

A schematic showing of a supply funnel 66 is included in FIG. 1. As suggested by that Figure, products to be packaged are deposited through the rectangular bag openings each time a bag is registered with the supply funnel at the load station.

A space adjusting mechanism as described in the SP Patents, but not shown, includes a spaced pair of adjustment screws. The adjustment mechanism drives the spreaders equally and oppositely into an adjusted spacial, but still parallel, relationship.

As loaded bags exit the load station, it is desirable to return upper portions of the bag faces and backs into juxtaposition. To facilitate this return the bag tops are stretched. This stretching of the now loaded bags as they exit the load station is accomplished with jets of air from nozzles 75, 76 which respectively direct air streams against the lead and trailing edges of the bag being stretched. This stretching of the bags assists in moving them from their rectangular orientations into face to back juxtaposed relationships as the transport belts are returned to juxtaposition.

The Improved Web

Figure 2:
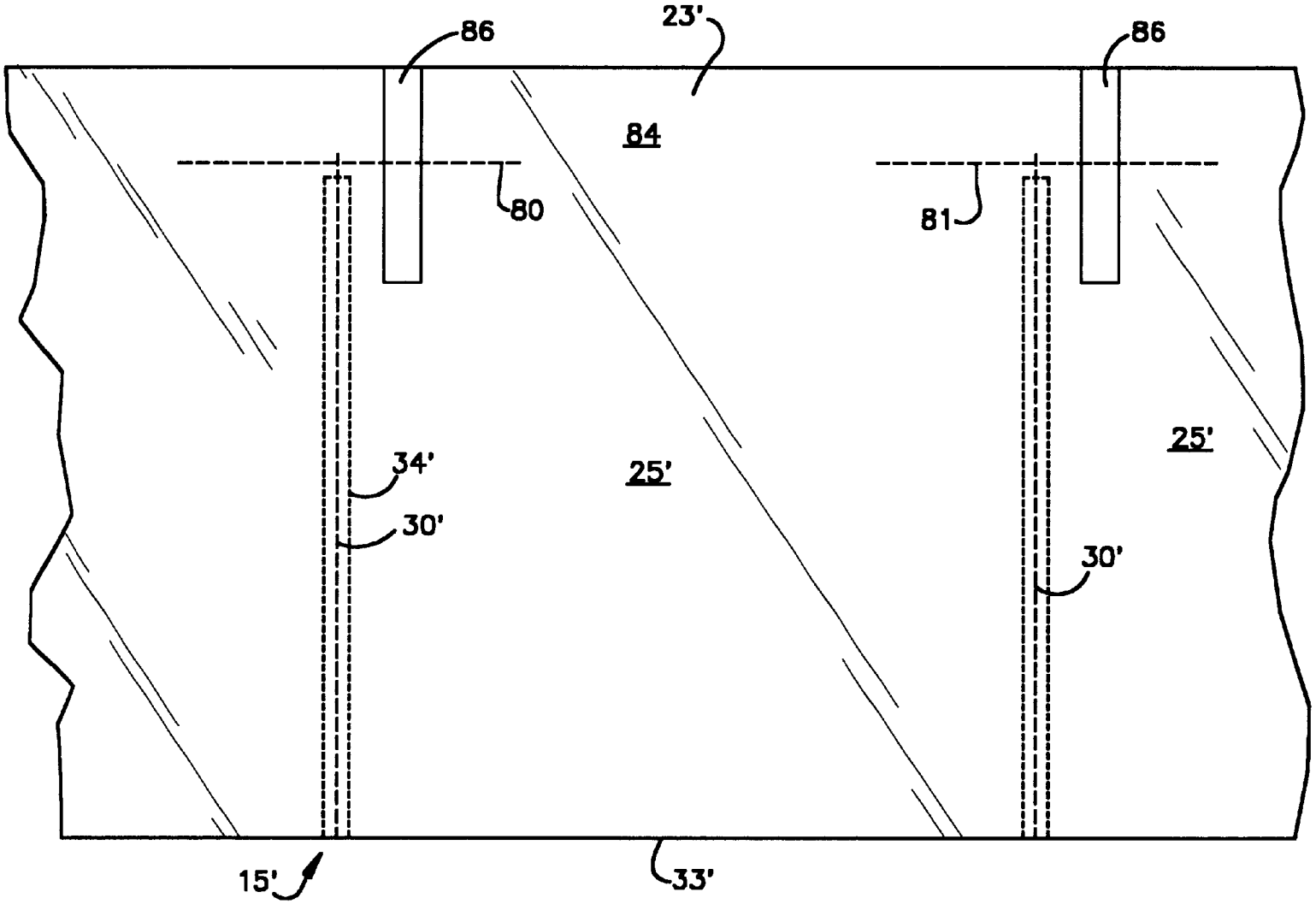

Referring now to FIG. 2, an improved web 15' is shown. The improved web 15' includes a top section 23' and side seals 34' each of which is bisected by a frangible side connection or line of weakness 30'. The top section 23' supports a plurality of side connected bags 25'. The web has a bottom 33'. On many occasions the web bottom 33' is delineated by what in fact will become the top of finish packages made from the bags 25'. Where each bag 25' is a header bag or a bag which includes a reusable closure, product loading is through what will become the bottom of the bag.

Each bag 25' includes a pair of spaced lines of weakness 80, 81 which provide an outstanding feature of the present invention. Each of the spaced lines 80, 81 extends from an associated frangible side connection or line of weakness to delineating the edge of the bag. The spaced lines of weakness extend toward one another from their respective and associated side lines of weakness terminating in spaced relationship with a solid section 84 of web therebetween in each of the face in the back of the web. Thus, while the web 15' is shown in side elevation in FIG. 2, it will be recognized that is has a face and a back just as its predecessor as shown in FIG. 1 and in the referenced SP and Process Patents.

Each of the spaced lines of weakness is of a length one-half the width to which that bag is to be opened when in the load station 17. Thus, aligned lines of weakness 80 in the face and a back, assuming the web of FIG. 2 is fed to the left, will define the top of a lead side of a bag passing through the load station 17 while the front and back lines 81 will define the trailing side.

Registration indicia are shown at 86 in FIG. 2. These indicia are preferably transparent and are made in accordance with the disclosure in U.S. Pat. No. 4,680,205 entitled Continuous Web Registration.

Operation

In operation a web 15' will be fed from a supply not shown to the web preparation station 35. There the top section 23' is fed over the mandrel 24 and split by the slitter 36 into opposed face and back web supporting lips. The lips are grasped by the belts 41, 42, 48, 49 and then transported into the load station 17. As each bag 25' enters the load station, the lips are separated from the bag along the lead lines of weakness 80. As the lead side of the bag enters into the load station the trailing side is separated this time along the trailing ones of the spaced lines of weakness 81.

As the web progresses through the load station each bag is firmly supported by its solid sections 84 so that heavier items then could be packaged with the bags of the SP and Process Patents can be supported. Moreover, the solid section 84 function to limit the extent of opening along the spaced lines of weakness 80, 81.

In setting up the machine or in feeding a new web through the machine after a previous web has completed its passage fine adjustments of the belt spreaders 60, 61 can be made to assure appropriate spacing for the web being fed and thus compensating for any variations due to such things a manufacturing variations within a tolerance range.

Although the invention has been described in its preferred form with a certain degree of particularity, it is understood that the present disclosure of the preferred form has been made only by way of example and that numerous. changes in the details of construction, operation and the combination and arrangement of parts may be resorted to without departing from the spirit and the scope of the invention as hereinafter claimed.

What is claimed is:

1. A packaging web comprising:

a) an elongate, flattened plastic tube having face and back sides delineating the faces and backs of a set of side by side bag portions;

b) the flattened tube including bag bottom structure interconnecting the bag faces and backs and delineating bottoms of side by side bag portions;

c) the bottom structure being a selected one of a fold, a reusable fastener and a seal;

d) the tube including an elongated top section;

e) spaced sets of side seals each extending transversely from the bottom structure to a location near the top section, the side seals of each set delineating sides of an adjacent pair of bags such that the sides and bottoms delineate the perimeters of a set of open top bags;

f) the top section being essentially a tube with a bottom opening, the top section being for providing bag support when the web is fed into a bag loading machine;

g) the top section being adapted to be slit to form a pair of strips which function as web supporting lips, the slitting occurring as the web is fed along a path of travel to form the supporting lips and the bag portions are supported by the lips as the web is fed through a bag loading station;

h) the web including superposed, spaced lines of weakness in each of the face and back sides delineating a top of each of the bags and demarcation lines between the bag faces and backs and the top section;

i) the web including further lines of weakness between adjacent bag sides to allow facile separation of adjacent bag sides; and, j) the spaced lines of weakness being generally normal to the further lines of weakness, each such spaced line of weakness extending substantially from an associated further line of weakness across an associated bag top and terminating in spaced relationship with an associated one of the spaced lines of weakness across the top of said associated bag top whereby to leave solid sections in the face and back atop said associated bag, the solid sections serving to limit separation of said associated bag from the lips along said spaced lines of weakness as the web is fed along the path of travel into and through the load station, thereby assuring rectangular bag opening and support for an item to be packaged when placed in said associated bag.

2. The web of claim 1 wherein the further lines of weakness are frangible connections between the side seals of adjacent bags.

3. The web of claim 1 wherein the further lines of weakness are each formed in an associated side seal.

4. The web of claim 1 wherein the spaced line of weakness are close perforations.

* * * * *